US009869535B2

(12) United States Patent
Johnston et al.

(10) Patent No.: US 9,869,535 B2
(45) Date of Patent: Jan. 16, 2018

(54) SYSTEM AND METHOD FOR BALLISTIC PROTECTION FOR A VEHICLE DOOR

(71) Applicant: Milspray, LLC, Lakewood, NJ (US)

(72) Inventors: Matthew L. Johnston, Bayville, NJ (US); Todd J. Bullivant, Tinton Falls, NJ (US); Christian E. Steinmetz, Mickleton, NJ (US); Jack Hayford, III, Brick, NJ (US)

(73) Assignee: MILSPRAY LLC, Lakewood, NJ (US)

( * ) Notice: Subject to any disclaimer, the term of this patent is extended or adjusted under 35 U.S.C. 154(b) by 0 days.

(21) Appl. No.: 14/855,167

(22) Filed: Sep. 15, 2015

(65) Prior Publication Data

US 2016/0187107 A1 Jun. 30, 2016

Related U.S. Application Data

(60) Provisional application No. 62/050,727, filed on Sep. 15, 2014.

(51) Int. Cl.

| | |
|---|---|
| ***F41H 7/02*** | (2006.01) |
| ***F41H 7/00*** | (2006.01) |
| ***F41H 5/04*** | (2006.01) |

(52) U.S. Cl.
CPC ..... *F41H 7/00* (2013.01); *F41H 5/0492* (2013.01)

(58) Field of Classification Search
CPC ..... F41H 5/0492; F41H 7/00; F41H 7/04
See application file for complete search history.

(56) References Cited

U.S. PATENT DOCUMENTS

| | | | | |
|---|---|---|---|---|
| 5,531,500 | A * | 7/1996 | Podvin | F41H 5/0478 109/49.5 |
| 5,811,719 | A * | 9/1998 | Madden, Jr. | B60R 21/12 296/146.7 |
| 6,027,158 | A * | 2/2000 | Yang | B60J 5/045 296/146.6 |
| 6,327,954 | B1 * | 12/2001 | Medlin | F41H 5/0407 296/96.21 |
| 6,746,975 | B2 | 6/2004 | Kavesh | |
| 7,793,579 | B1 * | 9/2010 | Lee | F41H 5/013 89/36.02 |

(Continued)

FOREIGN PATENT DOCUMENTS

| | | | | |
|---|---|---|---|---|
| DE | 4236234 | A1 * | 4/1994 | B60J 5/042 |
| DE | 10002447 | A1 * | 8/2001 | F41H 5/226 |

(Continued)

OTHER PUBLICATIONS

Schwerdt, Achim; Aug. 16, 2001; DE 10002449 A1, machine translation German to English obtained from Espacenet, downloaded Aug. 14, 2017.

*Primary Examiner* — Gabriel Klein
(74) *Attorney, Agent, or Firm* — Freeman Intellectual Property Law LLC; Mark E. Freeman

(57) ABSTRACT

The invention is a method for applying ballistic protection to a vehicle door to protect against ballistic impact comprising: obtaining a plurality of ballistic-resistant panels, inserting each of said plurality of ballistic-resistant panels into an interior cavity of the vehicle door; and attaching each said plurality of ballistic-resistant panels to an interior surface of an exterior door panel of the vehicle door so as to form said contiguous ballistic-resistant panel assembly inside said interior cavity.

11 Claims, 5 Drawing Sheets

(56) References Cited

U.S. PATENT DOCUMENTS

| | | | | |
|---|---|---|---|---|
| 7,997,181 | B1 * | 8/2011 | Tunis | F41H 5/0435 89/36.02 |
| 2003/0150321 | A1 * | 8/2003 | Lucuta | F41H 5/0428 89/36.02 |
| 2004/0258909 | A1 | 12/2004 | Tam | |
| 2005/0262999 | A1 * | 12/2005 | Tomczyk | F41H 5/0457 89/36.02 |
| 2006/0035078 | A1 | 2/2006 | Tam | |
| 2009/0139091 | A1 * | 6/2009 | Tucker | F41H 5/013 29/897.2 |
| 2009/0320675 | A1 * | 12/2009 | Landingham | F41H 5/0407 89/36.02 |
| 2013/0160639 | A1 * | 6/2013 | Lee | E04F 15/02038 89/36.02 |
| 2014/0116235 | A1 * | 5/2014 | Berroth | F41H 5/0428 89/36.02 |
| 2015/0268010 | A1 * | 9/2015 | Strauss | F41H 7/044 89/36.02 |

FOREIGN PATENT DOCUMENTS

| | | | | |
|---|---|---|---|---|
| DE | 10002449 | A1 * | 8/2001 | F41H 5/013 |
| GB | 2451626 | A * | 2/2009 | F41H 5/013 |

* cited by examiner

SYSTEM AND METHOD FOR BALLISTIC PROTECTION FOR A VEHICLE DOOR

FIELD OF THE INVENTION

This invention relates to a system and method of protecting vehicle occupants from ballistic threats and, more particularly, to a method of applying ballistic protection to a vehicle door to protect against gunfire.

BACKGROUND OF THE INVENTION

When a vehicle is driven or occupied under adverse, life-threatening circumstances, such as when there is a potential threat of gunfire, the driver and occupants would feel safer if the vehicle provided protection against bullets and other types of ballistic projectiles. This is particularly true for law enforcement personnel, who put their lives on the line essentially every working day.

However, standard issue police vehicles typically provide no ballistic protection beyond the sheet metal and metal structure used in ordinary commercial vehicles. For vehicles that are afforded some additional degree of ballistic protection, the fortification process requires modification of the vehicle for emplacement of ballistic panels. It is understood that "soft ballistic panels," such as soft armor and flexible KEVLAR®, are not ideal for such applications.

Many commercially available ballistic-resistant panels adapted for automotive use are single-piece, flat panels that cover a significant portion of the visible regions of an automotive door body. Installation of the ballistic-resistant panels may thus require door modification, or complete removal of the interior door trim panels. This modification may result in the limiting or elimination of the functions of certain automotive electronics, such as, for example, speakers, door-mounted controls, and door-mounted electric rear-view mirror controls. What is needed is a method of reinforcing automotive door panels without interfering with the electrical components of the doors, and without interfering with the mechanical components of the doors, such as windows, release mechanisms, and side-impact air bags.

DETAILED DESCRIPTION OF THE INVENTION

The present invention results from the observation that specific composite, or multi-laminar, ballistic-resistant panels are extremely effective at reducing threat/risk of ballistic penetration. These ballistic-resistant panels are of rigid construction, and exhibit little or no deformation after being impacted by ballistic stimuli. Preferably, the ballistic-resistant panels meet the ballistic resistance standards as specified in the Underwriters Laboratories (UL) Standards for ballistic resistant materials, National Institute of Justice (NIJ) Standards for ballistic resistant materials, or similar standards.

In an exemplary embodiment, the specific composite may comprise a multi-laminar woven fiberglass textile imbedded within a polymer system. The imbedded polymer is cured to create a rigid composite with the fiberglass. Such fiberglass panels, utilizing woven-roving fiberglass compressed within resin material, are commercially available from Waco Composites of Waco, Tex. In an exemplary embodiment, Kevlar textile may also comprise the textile imbedded with a polymer system. The imbedded polymer is cured to create a rigid composite with the Kevlar textile.

In an exemplary embodiment, an adhesive having a composition predominantly of polyether chemistry may be used for attaching precision-cut, rigid ballistic panels within a vehicle door cavity. The polyether adhesive bonds well to both the rigid ballistic panel and the interior fascia of the exterior vehicle door sheet metal.

The polyether adhesive maintains adequate bonding strength to hold the rigid ballistic panels securely in place, even after the rigid ballistic panels, and/or the polyether adhesive, has been subjected to the force of ballistic impacts. A suitable polyether adhesive may be available from 3M Company, the polyether adhesive formulated and marketed as 3M™ Impact Protection Adhesive.

In a conventional application, the polyether adhesive is adhered to a window for hurricane protection, the polyether adhesive intended to create a peripheral bond between the window film itself and the window frame for which the window is housed. Should the window glass shatter, the glass fragments would traditionally become dislodged from the window frame. The addition of the polyether adhesive provides a bonded flexible backing to the glass, the polyether adhesive bonding the film to the window frame.

Figure 1:
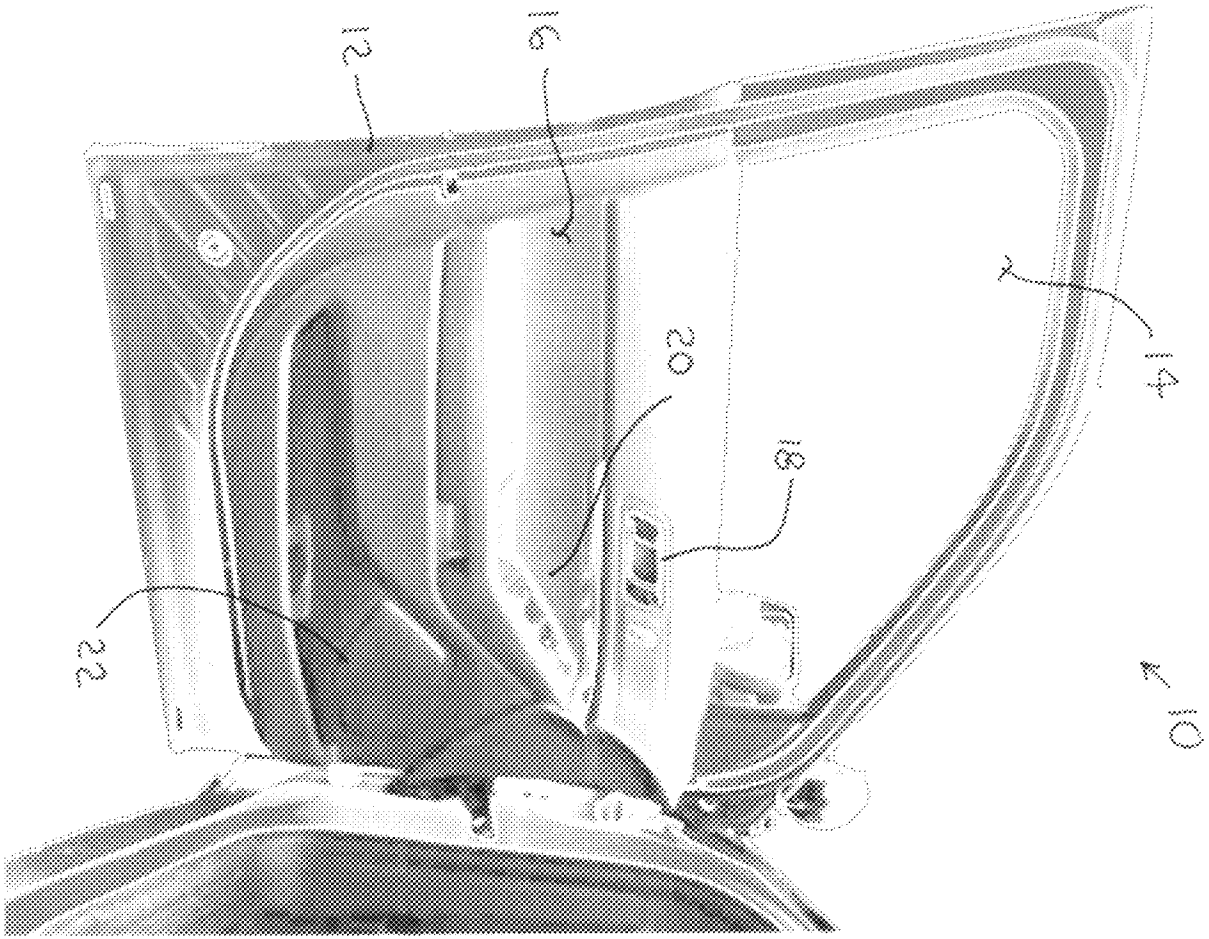
Fig. 1 (Prior Art)
FIG. 1 is an illustration of a conventional vehicle door, in accordance with the present state of the art.

There is shown in FIG. 1 a conventional vehicle door 10 comprising a vehicle door frame 12, a window 14, a door trim panel 16, an interior door latch release handle 18, door-mounted electrical controls 20, and a speaker/grille 22. The process of fortifying the vehicle door 10 begins with the removal of the components that mount onto the surface of the trim panel 16, such as the speaker/grille 22, the door-mounted electrical controls 20, and the interior door latch release handle 18.

Figure 2:
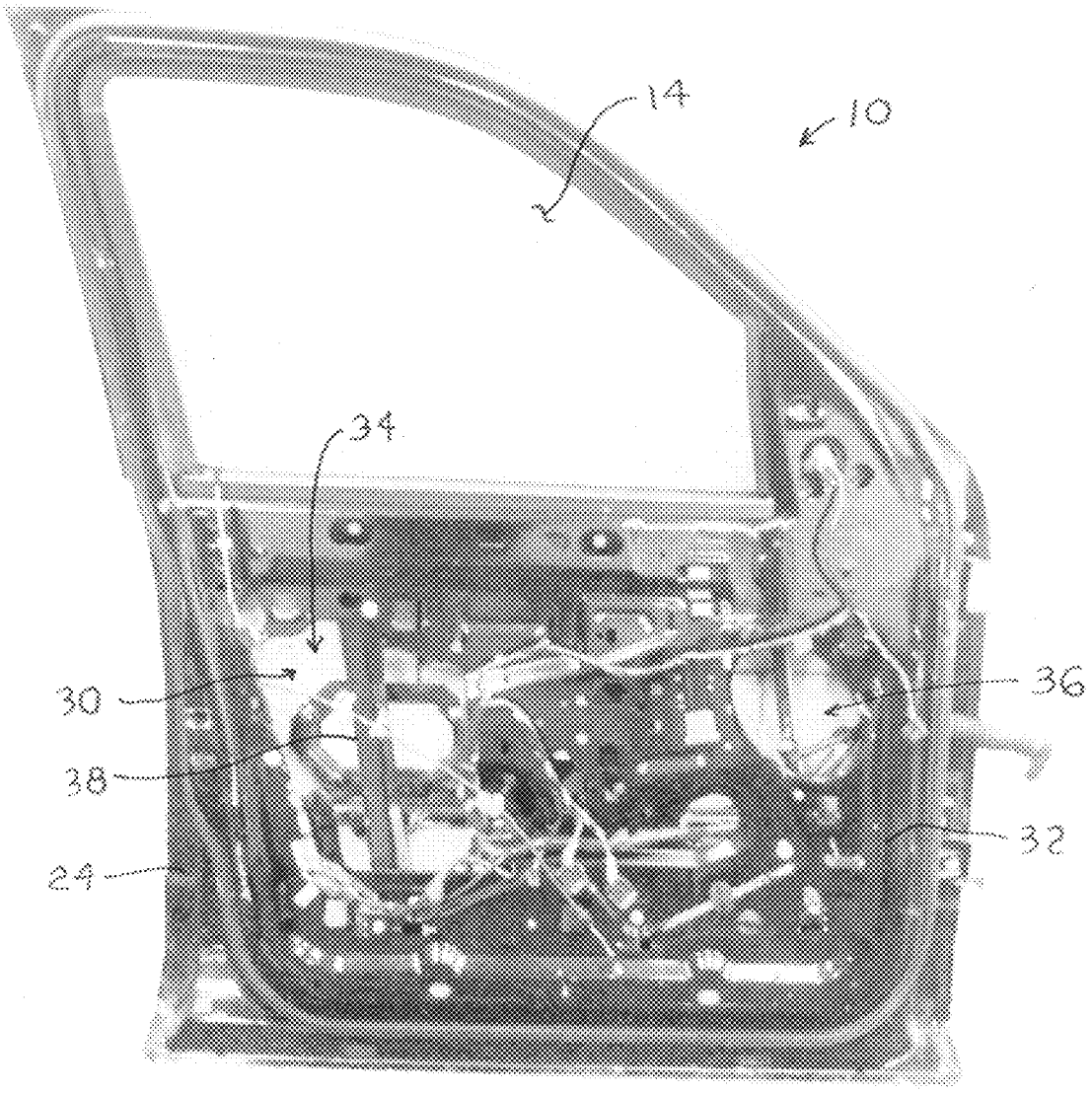
Fig. 2 (Prior Art)
FIG. 2 is an illustration of the vehicle door of FIG. 1, showing interior door components.

The door trim panel 16 may be removed next to expose various interior components of the vehicle door 10, as shown in FIG. 2. Such interior components may include wiring harnesses and mechanical linkages, for example. The vehicle door 10 may next be voided of all coverings, trim panels, clips, and handles, as necessary to enable ample access to an interior cavity 30. It should be understood that the interior cavity 30 is an open volume extending between an exterior sheet metal 24 of the vehicle door 10 and the interior components of the vehicle door 10.

In the example provided, user access to the interior cavity 30 may be realized enabled via openings in an interior sheet metal structure 32, such as a first cavity opening 34 and/or a second cavity opening 36. Access may be restricted by the positions of other structural door members such as, for example, a strut 38 used for guiding the operation of the window 14.

Figure 3:
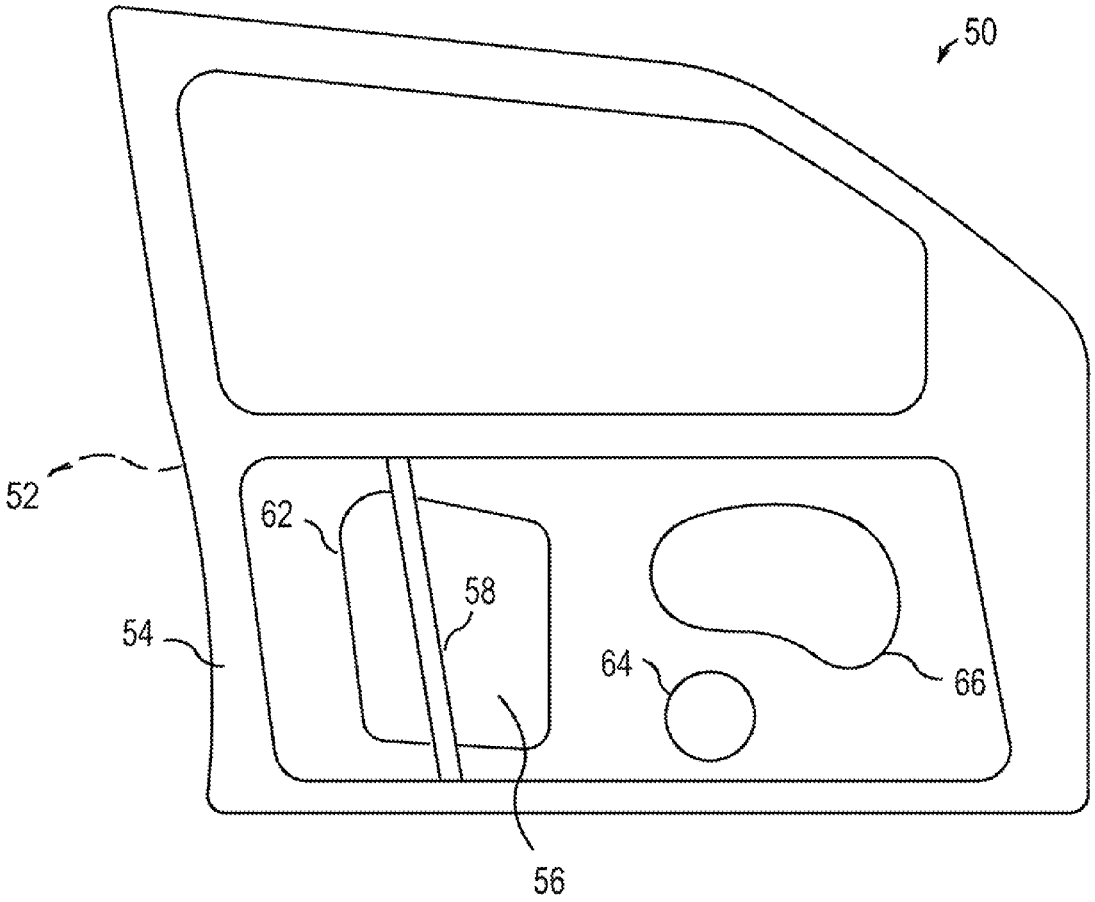
Fig. 3 (Prior Art)
FIG. 3 is a diagrammatical illustration of a vehicle door showing an exterior sheet metal door panel, an interior door frame, and an interior cavity extending between the exterior door panel and the interior door frame, in accordance with the present state of the art'

FIG. 3 is a simplified diagrammatical illustration of a conventional vehicle door 50 showing an exterior door panel 52, an interior metal door frame 54, and an interior cavity 56 extending between the exterior door panel 52 and the interior door frame 54. The interior door panel 52 may include a first opening 62, a second opening 64, and a third opening 66. A strut 58 may be disposed across the first opening 62. Additional interior components of the vehicle door 50 are not shown for clarity of illustration.

Figure 4:
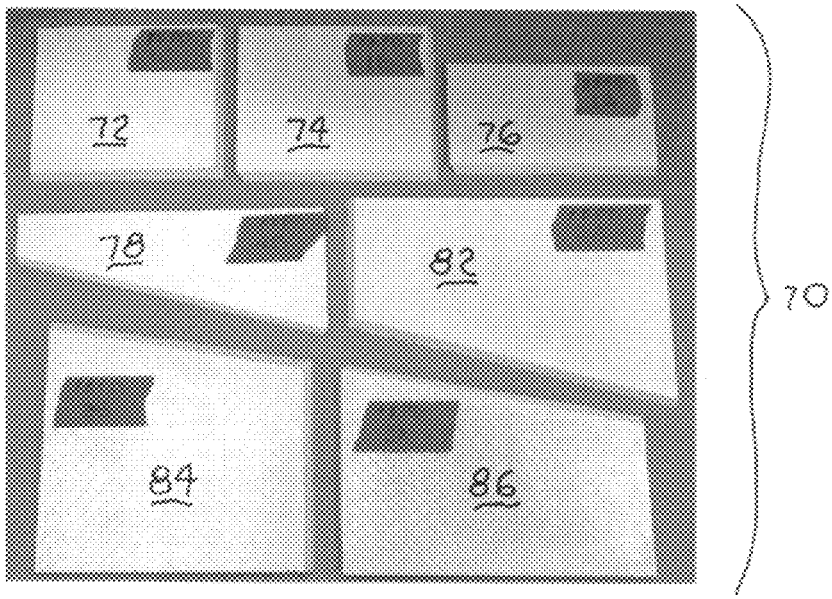
FIG. 4 is an illustration of the ballistic-resistant panels for piecewise placement into the interior cavity of FIG. 3, in accordance with the present invention.

In accordance with the present invention, a set of pre-cut ballistic-resistant panels 70, shown in FIG. 4, is used in a process to provide ballistic protection for the vehicle door 50 by constructing a ballistic protection layer inside the vehicle door 50. The set of ballistic-resistant panels 70 may be individually inserted into the interior cavity 56 of FIG. 3, and arranged into a planar shape generally conforming to the interior volume available in the interior cavity 70, as explained in greater detail below. Placement of each ballistic-resistant panel into the interior cavity 56 is enabled by passing the individual ballistic-resistant panel through the first cavity opening 62 and/or the second cavity opening 64, and/or the third cavity opening 66.

Relatively small openings, such as the second opening 64, may be used for placement of smaller ballistic-resistant panels when access to a particular region of the interior cavity 56 is not possible using the first cavity opening 62 and/or the third cavity opening 66. The size and shape of each individual ballistic-resistant panel, such as those panels in FIG. 4, is determined by: (i) the position of the individual ballistic-resistant panel in a reassembled ballistic-resistant panel assemblage, and (i) the sizes, shapes, and positions of the available openings in the interior door frame 54, such as the openings 62, 64, 66.

Each ballistic-resistant panel may be fabricated from a fiberglass composite having woven-roving fiberglass compressed within resin material. In an exemplary embodiment, a ballistic-resistant panel may comprise a multi-laminar woven Kevlar textile imbedded with a polymer system. The imbedded polymer may be cured to create a relatively rigid composite with the Kevlar textile. The thickness of the rigid composite may vary from approximately 4.7625 mm to about 36.5125 mm.

In the particular example provided, the ballistic-resistant panel set 70 comprises ballistic-resistant panels 72-78 and 82-86. It should be understood that the number of the ballistic-resistant panels 72-78 and 82-86, and the individual shapes of each of the ballistic-resistant panels 72-78 and 82-86 depends upon the size and shape of the interior cavity 56. The ballistic-resistant panels 72-78 and 82-86 may be further cut to a size to snugly fit around braces, beams, and moldings disposed within the interior cavity 56 of the vehicle door 50.

As can be appreciated by one skilled in the art, the size and shape of the interior cavity 56 is, in turn, a function of the year, make, and model of the vehicle to which the vehicle door 50 is attached. Preferably, a set of templates may be constructed from the initial fabrication of the ballistic-resistant panels 72-78 and 82-86, where the set of templates can be used to fabricate additional sets of ballistic-resistant panels 72-78 and 82-86 for use in similar vehicle doors 50.

Figure 5:
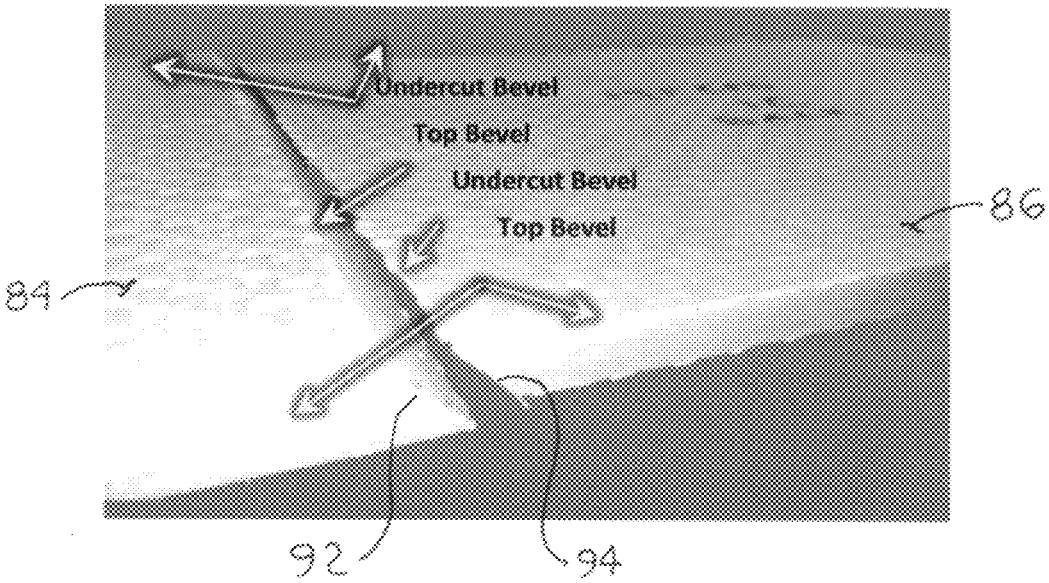
FIG. 5 is an illustration of how adjoining ballistic panels of FIG. 4 interface at respective mating bevel surfaces.
Figure 6:
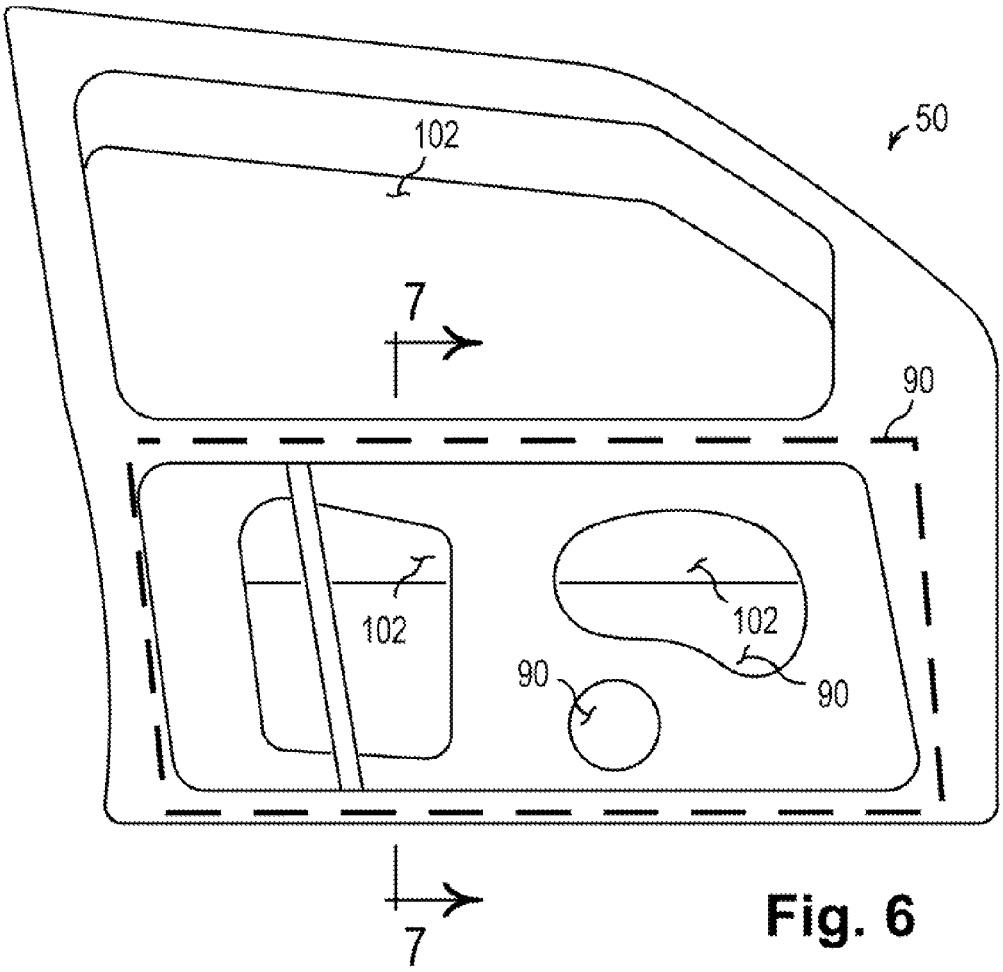
FIG. 6 is a diagrammatical illustration of the vehicle door of FIG. 3 with the ballistic panels of FIG. 4 emplaced into the interior cavity.
Figure 7:
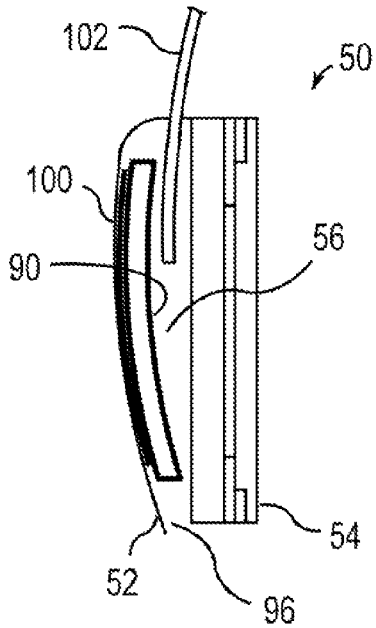
FIG. 7 is a diagrammatical cross-sectional illustration of the vehicle door of FIG. 6.

In a preferred embodiment, bevel cuts are used to precisely fabricate the ballistic-resistant panels 70 to provide an overlap of adjacent panels at the mating regions when installed in the modified door panel. As shown in FIG. 5, adjoining ballistic-resistant panels 84 and 86 may interface at respective mating bevel surfaces 92 and 94. The configuration provides a top bevel surface 94 that overlies the bottom bevel surface 92 when the ballistic-resistant panels 84 and 86 are emplaced and secured in the interior cavity 56. Alternatively, a second panel may be installed by partially sliding over a first, previously-installed adjacent panel (not shown) to provide an overlap of the two panels without the need for fabricating bevel cuts in the individual panels. These non-beveled overlap regions will have twice the thickness of a single panel, as there are two panel layer thicknesses in the overlap regions, and may be used when the volume of the interior space permits. It can be appreciated that each of the ballistic-resistant panels 72-78 and 82-86 has at least one beveled edge.

These overlapped or beveled configurations provides a more uniform barrier against ballistic projectiles than does a configuration comprising non-overlapped panel segments with butt-joint edges. Generally, each individual ballistic-resistant panel features a supplementary bevel precisely 180 angular degrees opposite the bevel angle of an adjacent ballistic-resistant panel. The resulting assembly of individual ballistic-resistant panels includes beveled edges that alternate 180 angular degrees from respective beveled edges of adjacent ballistic-resistant panels. It can be appreciated that, when beveled, the bevels of each ballistic-resistant panel are further defined as supplementary angled bevels. As described above, the sum of the thickness of two ballistic-resistant panels through any given point of overlap is equivalent to the total thickness of either ballistic-resistant panel within an area of that ballistic-resistant panel that does not include a bevel.

Further reinforcement of the supplementary angled bevels of adjacent joining panels may incorporate the adhesion of the disclosed ballistic-resistant composite onto such adjacent joining panels such that the reinforcement panel overlaps each underlying beveled panel by at least twenty-five millimeters. Such reinforcement serves to ensure sufficient ballistic resistance of such adjoining beveled panels without deviating from the scope of the present invention. The reinforcement layer may comprise a thickness approximately the same, or smaller, as the panel thickness.

The ballistic-resistant panels 72-78 and 82-86 are assembled and attached to an interior surface 96 or fascia of the exterior door panel 52 to form an attached unitary contiguous ballistic-resistant panel assembly 90, that is, a ballistic protection layer inside the vehicle door 50. By a "contiguous panel" is meant a substantially flat panel comprised of assembled individual panels wherein each individual panel shares an edge or a boundary with one or more adjacent panels. In an exemplary embodiment, the ballistic-resistant panels 72-78 and 82-86 are sized and shaped such that the ballistic-resistant panels 72-78 and 82-86 may be arranged on a surface such that each ballistic-resistant panel 72-78 and 82-86 is proximate to or touching at least one adjacent ballistic-resistant panel 72-78 and 82-86. The resulting arrangement is a planar assembly substantially conforming to the contiguous ballistic-resistant panel assembly 90 as attached to the interior surface 96 of the exterior door panel 52.

Each of the ballistic-resistant panels 72-78 and 82-86 may comprise a geometric shape with straight or curved edges, as shown. Each cut ballistic-resistant panel 72-78 and 82-86 is attached to the interior surface 96 or fascia of the exterior door panel 52 by means of an adhesive 100. Alternatively, an epoxy, or mechanical fasteners such as, clips, screws, or other means by which the panel segments 72-78 and 82-86 may be securely fastened within the interior cavity 56 of the vehicle door 50 may be used in place of or in addition to the adhesive 100.

In an exemplary embodiment, the fabrication method may include a step wherein a fifty millimeter, or wider, strip of composite is adhered to the reinforcement panel so as to overlap one or more connecting "seams" as the unitary contiguous ballistic-resistant panel assembly 90 is being installed. These seams can be the beveled seams or the overlapped sheets, as described above. As can be appreciated, because the beveled seams have a lower level of structural strength, such added reinforcement may increase the structural integrity of the unitary contiguous ballistic-resistant panel assembly 90. Moreover, after the unitary contiguous ballistic-resistant panel assembly 90 has been attached to the interior surface 96, additional fifty millimeter strips of composite may be added over accessible connecting seams.

In an exemplary embodiment, an adhesive having a composition predominantly of polyether chemistry may be used as the adhesive 100 for attaching the ballistic-resistant panels 72-78 and 82-86 against the interior surface 96 or fascia within the interior cavity 56. A suitable polyether adhesive can be obtained from 3M Company, the polyether adhesive formulated and marketed as 3M™ Impact Protection Adhesive. Alternative adhesive compounds include, without limitation, epoxies, urethane, polyurethane, silicone, and latex, for example.

The adhesive 100 bonds the ballistic-resistant panels 72-78 and 82-86 to the interior surface 96 or fascia, of the exterior door panel 52. The adhesive 100 maintains bonding strength so as to hold the ballistic-resistant panels 72-78 and 82-86 securely in place, even after the contiguous ballistic-resistant panel assembly 90 and/or the adhesive 100, has been subjected to the force of ballistic impacts. The adhesive 100 is given ample time to cure after application, in accordance with laboratory testing or manufacturer's instruction, prior to exposing the vehicle door 50 to any forces or trauma.

In an exemplary embodiment, a second contiguous ballistic-resistant panel assembly (not shown) can be installed onto the installed contiguous ballistic-resistant panel assembly 90 as a second layer to provide greater protection against ballistic threats, using any of the above-described adhesive compounds. Preferably, the second contiguous ballistic-resistant panel assembly will have a mosaic pattern of ballistic-resistant panels in a different configuration from the mosaic pattern of ballistic-resistant panels in the contiguous ballistic-resistant panel 90 attached to the interior surface 96 of the exterior door panel 52. This configuration functions to maximize ballistic resistance of the two-layer panel combination.

The vehicle door 50 may be completely reassembled with full functionality of door components. The assembled unitary contiguous ballistic-resistant panel assembly 90 is thus concealed from view after a trim panel (not shown) is reattached to the interior door frame 54. Additionally, the assembled unitary contiguous ballistic-resistant panel assembly 90 is configured so that there is no interference with electrical components inside the vehicle door 50, and no interference with the mechanical workings of the vehicle door 50 such as, for example, operation of the window 102, functions of release mechanisms, and deployment of any side-impact air bags.

It is to be understood that the description herein is only exemplary of the invention, and is intended to provide an overview for the understanding of the nature and character of the ballistic protection systems. The accompanying drawings are included to provide a further understanding of various features and embodiments of the method and devices of the invention which, together with their description serve to explain the principles and operation of the invention.

What is claimed is:

1. A method of applying ballistic-resistant panels within an assembled vehicle door for protection of vehicle occupants against impact of a ballistic projectile, the assembled vehicle door comprising an interior sheet metal structure and a sheet metal exterior door panel having an exterior surface and an interior fascia, wherein the interior sheet metal structure and the sheet metal exterior door panel are spaced apart to form an interior cavity, wherein the method comprises obtaining a plurality of rigid, multi-laminar woven and resin composite ballistic-resistant panels that are assembled within the door to form a first contiguous, ballistic-resistant panel assembly that covers surfaces of the interior fascia of the exterior door panel exposed to the interior cavity, such that entry of the ballistic projectile through the exterior door panel impacts the panel assembly;

accessing the interior fascia of the exterior door panel through one or more openings in the interior sheet metal structure;

inserting the ballistic-resistant panels through the openings into the interior cavity of the vehicle door without altering the exterior door panel; and securing the inserted ballistic-resistant panels to the interior fascia of the exterior door panel to form the first contiguous, ballistic-resistant panel assembly inside the interior cavity, wherein the first contiguous ballistic-resistant panel assembly conforms to the shape of the fascia to which the panel assembly is secured and does not interfere with functionality or operation of door components, nor does presence or the securing of the panel assembly alter any external surface of the exterior door panel.

2. The method of claim 1 wherein the ballistic-resistant panels comprise multi-laminar woven-roving fiberglass compressed within resin material.

3. The method of claim 1, wherein the securing comprises applying an adhesive to the interior fascia of the exterior door panel or to at least one of the plurality of ballistic-resistant panels prior to the securing the at least one of the plurality of ballistic-resistant panels to the fascia.

4. The method of claim 3, wherein the securing further comprises arranging the one or more ballistic-resistant panels such that at least one edge of each ballistic-resistant panel that forms the contiguous panel assembly abuts one or more edges of at least one adjacent ballistic-resistant panel that comprises the first contiguous ballistic-resistant panel assembly.

5. The method of claim 4, wherein the securing comprises overlapping instead of abutting adjacent edges of adjacent ballistic-resistant panels that comprise the contiguous ballistic-resistant panel assembly.

6. The method of claim 4, wherein the abutted edges further comprise attaching at least one strip of a multi-laminar woven fiberglass textile composite spanning the abutted edges of the adjacent ballistic-resistant panels, thereby to prevent inhibiting ballistic penetration between abutted edges of adjacent panels.

7. The strip of claim 6, which is at least about 50 millimeters wide.

8. The method of claim 4, wherein the edge of at least one ballistic-resistant panel is beveled and the abutted edge of an adjacent panel is beveled at a complementary angle, whereby the abutting comprises abutting the beveled edge of the at least one ballistic-resistant panel against the complementary beveled edge of the adjacent ballistic-resistant panel.

9. The method of claim 8, wherein the abutting further comprises attaching at least one strip of a multi-laminar woven fiberglass textile composite so that the strip spans a seam formed by the abutted edges of the adjacent ballistic-resistant panels.

10. The method of claim 3, wherein the securing comprises applying an adhesive to at least one of the plurality of ballistic-resistant panels prior to the securing of the panel to the fascia.

11. The method of claim 1 further comprising forming a second ballistic-resistant panel assembly layered over the first contiguous ballistic-resistant panel assembly, wherein the panels comprising the second contiguous ballistic-resistant panel assembly form a mosaic pattern of ballistic-resistant panels different from the mosaic pattern formed by the ballistic-resistant panels forming the first contiguous ballistic-resistant panel assembly, thereby minimizing ballistic penetration between adjacent edges of any panels of both the first and second panel assemblies.

* * * * *